US006307157B1

(12) United States Patent
Fujii et al.

(10) Patent No.: US 6,307,157 B1
(45) Date of Patent: Oct. 23, 2001

(54) COMPOSITE INSULATORS AND A PROCESS FOR PRODUCING THE SAME

(75) Inventors: Shuji Fujii, Komaki; So Kawamura, Kasugai, both of (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 08/406,392

(22) Filed: Mar. 20, 1995

(30) Foreign Application Priority Data

Mar. 28, 1994 (JP) ..... 6-057616

(51) Int. Cl.[7] ..... H01B 17/38

(52) U.S. Cl. ..... 174/176; 174/178; 174/209; 174/212

(58) Field of Search ..... 174/176, 178, 174/209, 179, 169, 210, 212; 29/887

(56) References Cited

U.S. PATENT DOCUMENTS

| | | | | |
|---|---|---|---|---|
| 3,898,372 | * | 8/1975 | Kalb | 174/179 |
| 4,045,604 | * | 8/1977 | Clabburn | 174/179 X |
| 4,440,975 | * | 4/1984 | Kaczergimski | 174/209 |
| 5,043,838 | * | 8/1991 | Sakich | 174/178 X |
| 5,220,134 | * | 6/1993 | Novel et al. | 174/178 X |

FOREIGN PATENT DOCUMENTS

| | | | | |
|---|---|---|---|---|
| 491474 | | 7/1970 | (CH) . | |
| 1932949 | | 1/1971 | (DE) . | |
| 2553795 | * | 6/1976 | (DE) | 174/179 |
| 0439411 | | 7/1991 | (EP) . | |

OTHER PUBLICATIONS

Sediver Catalogue, Toughened Glass And Composite Insulator Products.

* cited by examiner

*Primary Examiner*—Albert W. Paladini
(74) *Attorney, Agent, or Firm*—Burr & Brown

(57) ABSTRACT

A composite insulator includes an insulating rod, end fittings crimped to opposite end portions of said insulating rod, and an elastic insulating material molded around the outer periphery of the insulating rod, wherein each of the end fittings has a flange around the outer periphery of an end fitting body on an axially external side thereof, and the elastic insulating material is molded around the outer periphery of the insulating rod and those of the end fitting bodies such that the elastic material extends up to and between the flanges. A process for the production of such a composite insulator is also disclosed.

4 Claims, 3 Drawing Sheets

COMPOSITE INSULATORS AND A PROCESS FOR PRODUCING THE SAME

BACKGROUND OF THE INVENTION (1) Field of the Invention

The present invention relates to composite insulators each formed by molding an elastic insulating material around an insulating rod having an end fitting connected to each of opposite ends thereof. The invention also relates to a process for producing the same.

(2) Related Art Statement

Recently, many composite insulators having light weight and high strength have been used. As shown in FIG. 3, the composite insulator includes an insulating rod 51 made of glass fiber-reinforced plastic (FRP) or the like, end fittings 54 crimped to opposite end portions of the insulating rod 51, respectively, and an elastic insulating material 53 molded around the outer periphery of the insulating rod 51. A plurality of shed portions 52*a* are integrally formed with sheath portions 52*b* from the insulating material 53. Each of the end fitting grasps an end portion of the elastic insulating material 53.

However, there is a problem when such a composite insulator is used in an existing power transmission system in which the entire length of the insulator is preliminarily determined, for example, a feeding system for railroads. That is, the entire length of the insulator to be used in the existing electric power transmission wire system is preliminarily determined, and if the above composite insulator is designed to have the thus preliminarily determined entire length, the composite insulator cannot satisfy an electric characteristic required as a reference value (Lightning impulse withstand voltage, e.g., 320 kV).

The reason why the electric characteristic of the composite insulator does not satisfy the reference value is that since the effective insulating length between the end fittings 54 is narrowed by themselves, an insulating effective insulating length cannot be sufficiently ensured. The effective insulating length between the end fittings 54 may be increased by increasing the the entire length of the insulating rod 51 and the molded elastic insulating material 53. The term "effective insulating length" used therein means a longitudinal space between both the end fitting. However, in this case, since the entire length of the rod 51, that is, the entire length of the composite insulator consequently increases, such an insulator cannot be used in the electric power transmission system in which the entire length of the insulator to be employed is preliminarily determined.

Further, in order to prevent invasion of water between the elastic insulating material 53 and the end fittings 54 in the composite insulator, it is necessary to provide a sealant 55 between the rod and the end fitting after the end fitting 54 is crimped around the rod 51. This is very inefficient from a manufacturing second point.

SUMMARY OF THE INVENTION

The present invention has been accomplished to solve the above-mentioned problem, and a first object of the present invention is to provide a composite insulator which has enhanced insulation tolerance and maintains strength by increasing the effective insulating length without increasing the entire length of the insulator.

A second object of the present invention is to provide a composite insulator in which an insulating material is molded around an insulating rod and end fittings without leaking the insulating material outside.

A third object of the present invention is to provide a process for producing such composite insulators.

The composite insulator according to the present invention comprises an insulating rod, end fittings crimped to opposite end portions of said insulating rod, and an elastic insulating material molded around the outer periphery of the insulating rod, wherein each of said end fittings has a flange around the outer periphery of an end fitting body on an axially external side thereof, and said elastic insulating material is molded around the outer periphery of the insulating rod and those of the end fitting bodies such that the elastic material extends up to and between the flanges.

According to this composite insulator, since the insulating material is molded around a part of each of the end fittings as well as around the rod, the effective insulating length of the insulator can be increased without increasing the entire length of the insulator. Further, leakage of the elastic insulating material during the molding thereof can be prevented by the flange of the end fitting. In addition, sealing is effected, with the elastic insulating material, between the rod and a peripheral surface of a hole of the end fitting into which an end of the rod is inserted.

The following are preferred embodiments of the composite insulator according to the present invention.

(1) The outer peripheral surface of each of the flanges is substantially flush with that of the elastic insulating material. Since the outer periphery of the flange is substantially flush with the outer periphery of the insulating material, concentration of the electric field can be prevented to suppress corona discharging.

(2) A portion of the molded insulating material surrounding the end fittings is thicker than the remainder of the insulating material. Since that portion of the insulating material surrounding the end fittings is thicker than the remainder of the insulating material, insulation can be assuredly realized between both the end fittings.

(3) An area at which the end fitting is to be crimped around the outer periphery of the insulating rod is divided into a plurality of zones in an axial direction of the rod, and crimping pressures at said zones under which the end fitting is crimped around the outer periphery of the rod are reduced as the crimping location approaches the open edge portion of the end fitting. If a high pressure is applied around the rod at the open edge portion of the end fitting, a crack may be develop toward the center of the rod made of FRR.

The process for producing the composite insulator according to the present invention, which composite insulator comprises an insulating rod, end fittings around opposite end portions of said insulating rod, and an elastic insulating material around the outer periphery of the insulating rod, each of said end fittings having an axial hole therein and a flange around the outer periphery of an end fitting body on an axially external side thereof, said process comprising the steps of:

(1) inserting the insulating rod into said holes of the end fittings at opposite ends thereof;

(2) crimping the end fittings around the outer periphery of the insulating rod;

(3) placing the insulating rod having the end fittings inside a mold; and (4) molding around the outer periphery of the insulating rod and the outer peripheries of the end fitting bodies such that the elastic material extends up to and between the flanges.

These and other objects, features and advantages of the invention will be appreciated upon reading of the following description in conjunction with the attached drawings, with the understanding that some modifications, variations and changes can be easily made by the skilled person in the art to which the invention pertains.

BRIEF DESCRIPTION OF THE DRAWINGS

For a better understanding of the invention, reference is made to the attached drawings, wherein.

DETAILED DESCRIPTION OF THE INVENTION

The present invention will be explained in more detail based on an embodiment of the present invention with reference to the attached drawings.

Figure 1:
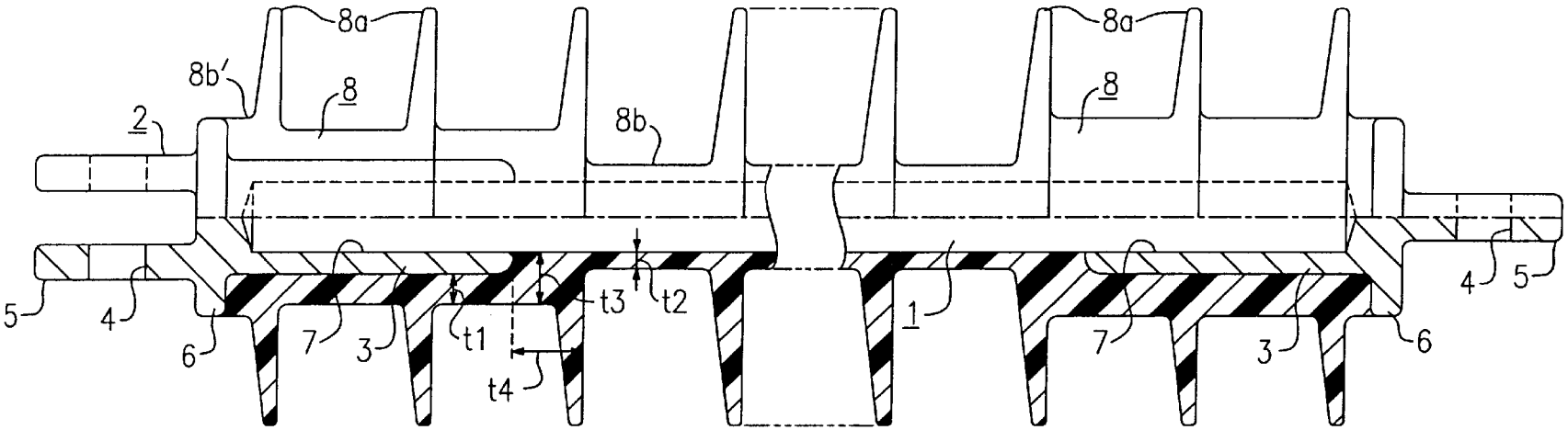
FIG. 1 is a front sectional view of a composite insulator as one embodiment of the present invention.
Figure 2:
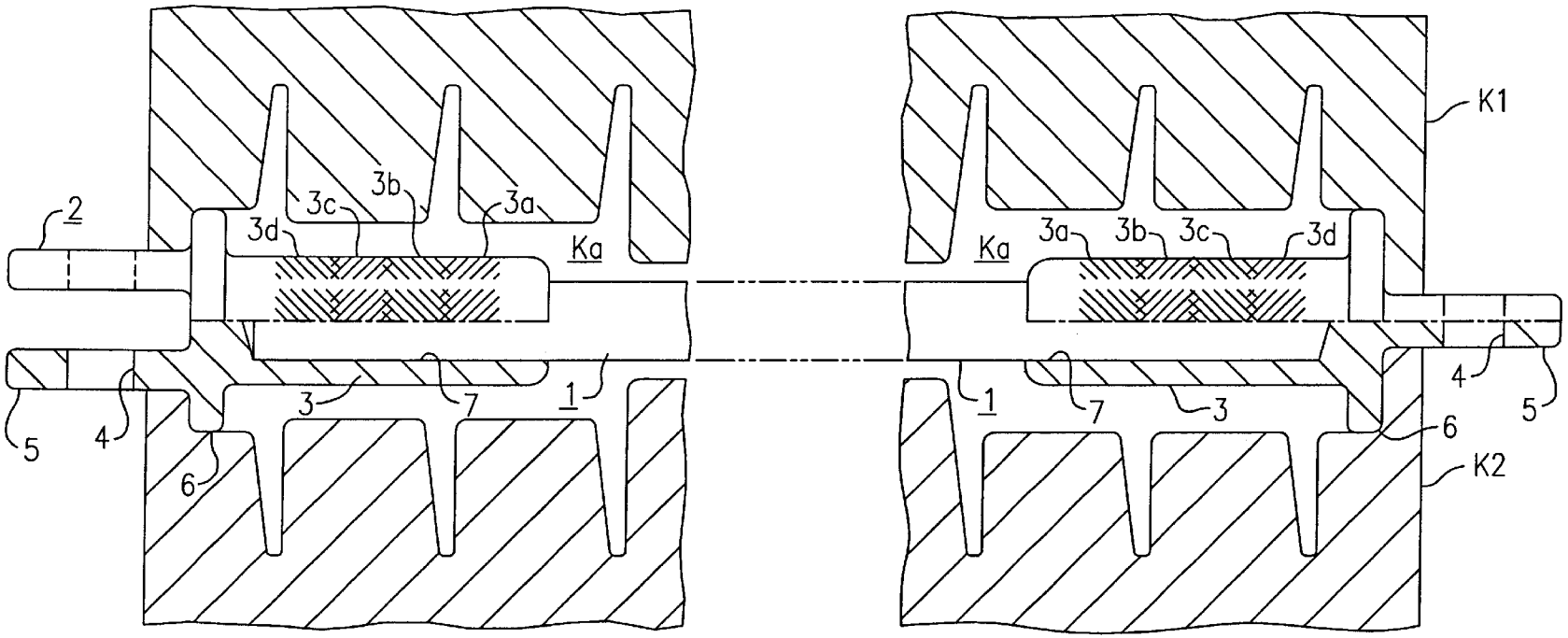
FIG. 2 is a front sectional view for illustrating a state that an insulating rod is placed in a mold together with end fittings before an insulating material is molded around them.
Figure 3:
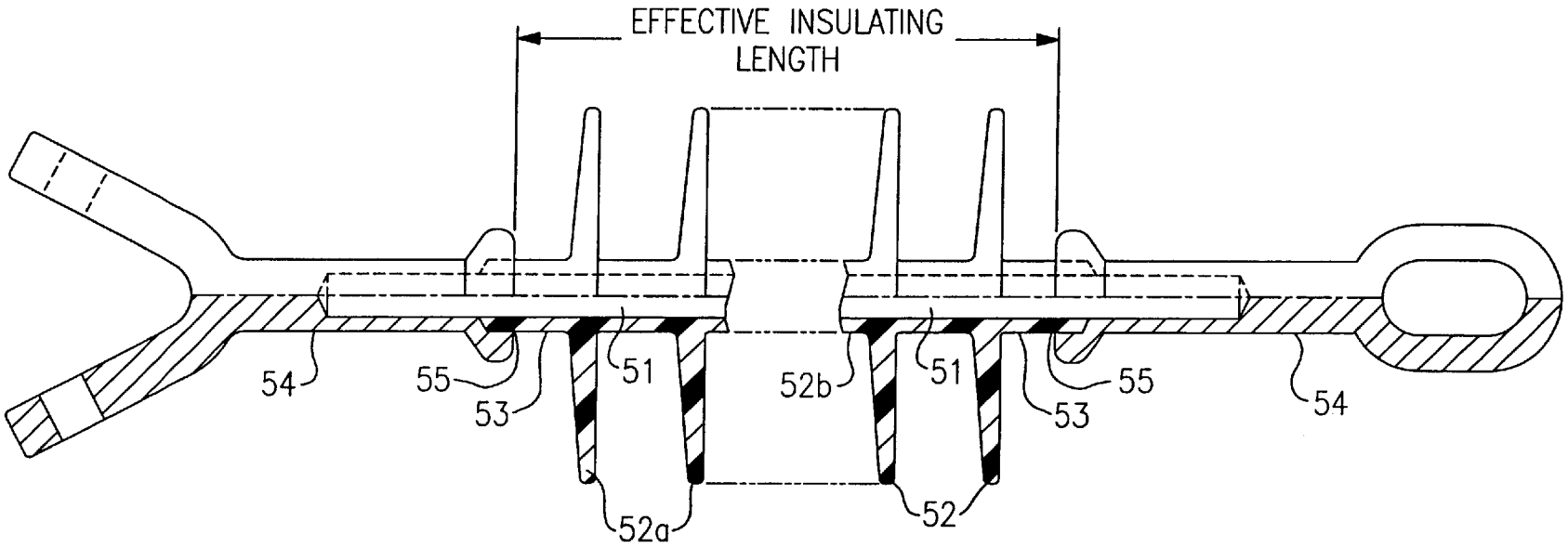
FIG.3 Prior Art
FIG. 3 is a front sectional view of the composite insulator as prior art.

As shown in FIGS. 1 and 2, a metallic end fitting 2 plated with zinc is connected to each of opposite end portions of a cylindrical insulating rod 1 made of FRP by crimping a cylindrical barrel portion 3 of the end fitting 2. The end fitting 2 includes the barrel portion 3, in which a blind-hole is provided for receiving the end portion of the insulating rod 1, a joint portion 5 at an axially outer end, and a flange portion 6. The flange portion 6 is formed integrally with the joint portion 5 and the barrel portion 3 at an axially outer end portion of barrel portion 3. The flange portion 6 extends radially outwardly from the end fitting 2. In the joint portion 5 is formed a hole through which a bolt (not shown) is passed. The end metallic fitting may be made of forged steel, ductile iron, malleable iron, aluminum, or the like.

Around the outer periphery of an exposed portion of the rod 1 and the outer peripheries of the barrel portion 3 of the end fittings 2, is molded an elastic insulating material 8 made of silicon rubber, ethylene-propylene rubber or the like. The elastic insulating material 8 includes a plurality of shed portions 8*a* and sheath portions 8*b*, 8*b*′ connecting the adjacent shed portions 8*a* or positioned axially outwardly from the axially outermost shed portions. In the illustrated embodiment, the thickness t1 of the elastic insulating material 8 molded around the outer periphery of the barrel portion of the end fitting is made greater than that t2 of the elastic insulating material 8 around the rod 1 by about 30% to about 40%. Further, the thickness t3 of the insulating material 8 around the outer periphery of the rod 1 near the barrel portion 3 is greater than that t2 of the insulating material 8 around the outer periphery of a middle portion of the rod 1, and the length t4 of the thickened portion at t3 is greater than the thickness t3.

As is seen from the above, the end fitting 2 is surrounded with a thicker portion of the elastic insulating material 8 as compared with the rod 1. In this embodiment, the outer periphery of the flange 6 is continued to and flush with the outer peripheral surface of the sheath portion 8*b*′ of the elastic insulating material 8 so that the flange 6 may not radially outwardly extend beyond the sheath portion 8*b*′ of the elastic insulating member 8. The radially outermost shed portion 8*a* is located near but axially inwardly from the flange 6.

Next, a process for producing the above composite insulator will be explained.

First, an inner peripheral surface of the rod-inserting hole 7 in the metallic end fitting 2 plated with melted zinc is roughened by removing a plated layer at the inner peripheral surface of the hole 7 using a boring tool or the like. Then, the rod 1 is inserted into the hole 7, and the barrel portion 3 of the end fitting 2 is crimping to the outer periphery of the rod 1. When the end fitting 2 is to be crimping around the rod 1, crimping is effected first at a crimping position 3*a* at an axially inner tip side of the barrel portion in FIG. 2. Crimping is further effected in the order of crimping positions 3*b*, 3*c* and 3*d*, following 3*a*. In this embodiment, the crimping is effected at the crimping positions 3*a* through 3*d* under different crimping forces or pressure by which the barrel portion 3 is crimped. That is, the crimping pressure is 128 kgf/cm$^2$ at the crimping position 3*a*, 150 kgf/cm$^2$ at the crimping position 3*b*, 164 kgf/cm$^2$ at the crimping position 3*c*, and 164 kgf/cm$^2$ at the crimping position 3*d*. That is, the crimping pressure is set greater as the crimping position approaches the axially outer side of the rod. In this embodiment, crimping is preferably effected in the state that the adjacent crimping locations partially overlap. In other words, it is preferable that the crimping force decreases as the crimping location approaches the open edge portion of the end fitting, so that high pressure is prevented from being applied to the insulating rod at the open edge portion of the end fitting.

After the end fittings are crimped around the rod 1, the elastic insulating material 8 is molded. In order to mold the elastic insulating material 8, the rod 1 and the barrel portions 3 of the end fittings 2 are placed inside a cavity Ka defined between mold units K1 and K2. When the temperature in the cavity reaches about 135° C., the elastic insulating material such as silicone rubber, ethylene propylene rubber or the like is charged in a melted state into the cavity around the rod and the barrel portions of the end fittings. The cavity Ka is heated at a given temperature (150° C.~180° C.) for, e.g., 10 minutes to effect vulcanization. By so doing, the elastic insulating material 8 is cured and molded around the rod 1 and the barrel portions 3 of the end fittings 2. At that time, the elastic insulating material 8 is molded around all the above-mentioned crimping positions 3*a* through 3*d*, while the elastic insulating material extends up to the flanges 6 of the end fittings 2 and is flush with the outer peripheral surface of the flange 6.

During the above producing process, although the melted elastic insulating material 8 charged into the cavity Ka tends to flow toward the outer end of the end fitting 2 under influence of the molding pressure, this flow is interrupted by the flange 6 of the end fitting 2. Consequently, outside leakage of the elastic insulating material 8 is prevented to assuredly mold the elastic insulating material 8 around the predetermined locations of the end fittings.

Since the composite insulator is constituted above in this embodiment, the following effects can be obtained.

(1) Since the elastic insulating material 8 is molded around the rod 1 and the barrel portions 3 of the end fittings 2, the entire axial length of the elastic insulating material 8 can be increased by lengths over which the barrel portions 3 are molded with the insulating material 8. Accordingly, the insulating effective effective insulating length of the insulator can be increased without increasing the entire length of the insulator. Therefore, the effective insulating length of the composite insulator can be largely enhanced, and increase in the entire length of the composite insulator can be avoided.

(2) Since the vicinity of the rod-inserting hole 7 of the metallic end fitting 2 is covered with the elastic insulating material 8, no separate sealing needs to be effected between the rod 1 and the rod-inserting hole 7. As a result, the producing process can be simplified, and the cost can be reduced.

(3) Since the large contact area between the flange 6 and the elastic insulating material 8 can be ensured, water is difficult to invade between the barrel portion 3 and the elastic insulating material 8. Therefore, no sealing is necessary between the barrel portion and the insulating material 8. As a result, the insulation can be ensured, the producing process can be simplified, and the cost can be reduced.

(4) Since the metallic end fitting 2 is provided with the flange 6, the flowing of the elastic insulating material 8 can be assuredly interrupted by the flange 6 on molding the elastic insulating material 8 to prevent leakage of the insulating material outside the flange.

(5) The crimping pressure for the barrel portion 3 becomes smaller as the crimping position approaches the open edge portion of the end fitting. In other words, the crimping pressure is made greater as the crimping position approaches the axially outer side. Accordingly, even if the rod 1 is thermally deformed (thermally expanded) on molding the elastic insulating material 8, an expanded portion of the rod can escape to the crimping positions 3*a*, 3*b* having the smaller crimping pressures to prevent breakage of the rod 1. In addition, since the crimping is effected before molding the elastic insulating material 8, the elastic insulating material can be prevented from entering between the insulating rod 1 and the end fittings 2, and reduction in the end forces of the end fitting 2 can be prevented.

(6) The thickness t1 of a portion of the elastic insulating material 8 around the outer periphery of the barrel portion 3 and the thickness t3 of a portion of the insulating material 8 around the outer periphery of the rod near the barrel portion are made greater than the thickness t2 of the elastic insulating material 8, and the length t4 of the thicken portion at t3 is made greater than the thickness t3. Therefore, the barrel portion 3 of the end fitting 2 is surrounded with the thickened portion of the elastic insulating material 8 so that insulation between the barrel portion 3 and the exterior and that between the end fittings can be assuredly ensured. Particularly, since the length t4 of the elastic insulating material 8 at the locations opposed to the barrel portions 3 of both the end fittings 2 is set greater, the opposite barrel portions 3 can be assuredly insulated from each other.

(7) When the inner peripheral surface of the rod-inserting hole of the metallic end fitting is roughened by removing the plated layer on the inner peripheral surface, very small projections are formed on the wall surface of the rod-inserting hole 7. Thereby, when the rod 1 is inserted into the hole 7, and the barrel portion 3 is crimped around the outer peripheral surface of the rod 1, the very small projections on the wall surface of the hole 7 bite the rod 1 so that the frictional resistance between the wall surface of the rod-inserting hole 7 and the rod 1 increases. As a result, the joining force between the rod 1 and the end fitting 2 is strengthened.

Since the crimping area of the end fitting is divided into plural zones along the axial direction of the rod 1 and the crimping is effected at such plural zones under application of different crimping pressures, reduction in the end force of the end fitting 2 due to the heat history of the rod on molding the elastic insulating material 8 can be suppressed.

The present invention is not limited to the above-mentioned embodiment, but the invention may be employed in various manners given below by way of example without departing from the scope of the invention.

(1) When the barrel portion 3 of the end fitting 1 is to be crimped around the outer periphery of the insulating rod, the crimping positions (e.g., 3*a* to 3*d*) are not overlapped with one another.

(2) The end fitting 2 is joined to the rod 1 in the state that the barrel portion 3 is crimped around the outer periphery of the rod at each of the crimping positions 3*a* through 3*d* under application of the same crimping pressure.

(3) Two crimped positions are overlap with each other at their adjacent areas as at 3*a* and 3*b*, and the elastic insulating material 8 is molded to cover the crimping positions 3*a* and 3*b*, exposing axially outward crimped portion as at 3*c* and 3*d*. Even by so constructing, similar effects to those as mentioned above can be obtained.

(4) The above explanation has been made by way of example mainly with respect to the case where the composite insulator according to the present invention will be employed in the electric power transmission system as one of the existing power transmission systems. The composite insulator according to the present invention may be used in other existing power transmission systems.

What is claimed is:

1. A composite insulator comprising:

an insulating rod;

end fittings crimped to opposite end portions of said insulating rod, each of said end fittings having a flange extending radially outwardly from an outer periphery thereof; and an integrally molded layer of elastic insulating material disposed around an outer peripheral surface of said insulating rod and around a portion of an outer peripheral surface of each of said end fittings such that said integral layer of elastic insulating material contacts said outer peripheral surfaces at substantially all points thereof and extends up to and between said flanges, wherein a thickness of said integral layer of elastic insulating material disposed around said end fittings is about 30% to about 40% thicker than substantially the entire remainder of said integral layer of elastic insulating material disposed around said insulating rod, to thereby prevent flashover between said end fittings through any portion of said elastic insulating material.

2. The composite insulator of claim 1, wherein the outer peripheral surface of each flange is substantially flush with that of the elastic insulating material.

3. The composite insulator of claim 1, wherein each of said end fittings has an axially extending cylindrical hole therein, said flange has an axially cylindrical outer shape, and said insulating rod is inserted into said axially extending cylindrical hole.

4. The composite insulator of claim 1, wherein said elastic insulating material includes a plurality of shed portions and a sheath portion or sheath portions between adjacent shed portions.

* * * * *